United States Patent [19]

Coxe

[11] 3,996,709

[45] Dec. 14, 1976

[54] PATIO HOUSING COMPLEX

[75] Inventor: Weld Coxe, Philadelphia, Pa.

[73] Assignee: Weld Incorporated, Columbia, S.C.

[22] Filed: June 4, 1975

[21] Appl. No.: 583,645

[52] U.S. Cl. ..... 52/169 DT; 52/79

[51] Int. Cl.[2] ..... E04H 1/00

[58] Field of Search ..... 52/79, 169 DT

[56] References Cited

UNITED STATES PATENTS

| | | | |
|---|---|---|---|
| 3,623,296 | 11/1971 | Santoro | 52/79 |
| 3,629,983 | 12/1971 | Jenn | 52/169 |
| 3,678,639 | 7/1972 | Panitz | 52/169 |
| 3,720,023 | 3/1973 | Stoop | 52/169 |
| 3,874,137 | 4/1975 | Gentry | 52/169 DT |

*Primary Examiner*—Alfred C. Perham
*Attorney, Agent, or Firm*—Paul & Paul

[57] ABSTRACT

A housing complex of patio houses is disclosed, with the houses in the complex each having a pair of parallel wings and an interconnecting part, with the wings generally being of non-durable construction, such as of the mobile home type, and with the connecting part generally comprising an interconnecting hallway between wings, and with a plurality of separating walls, preferably of the durable construction type, such as concrete or the like, separating adjacent houses, and with the houses being arranged relative to the separating walls to define at least one patio therebetween, with an access opening to the patio between an end of one of the wings and a separating wall.

8 Claims, 4 Drawing Figures

PATIO HOUSING COMPLEX

BACKGROUND OF THE INVENTION

In the prior art, various combinations of housing complexes have been developed, some of which are adapted to lend themselves to the use of mobile home units as building components. An example of this would be in U.S. Pat. No. 3,720,023.

Other types of housing concepts preclude the versatility, ease of construction, and adaptablity provided by the use of non-durable components such as of the mobile home variety.

THE PRESENT INVENTION

The present invention is directed toward a recognition that a useful living environment of high quality can be provided by using a non-durable shelter unit concept that is adaptable for use with separating walls that may be of the durable type, allowing for periodic replacement of the non-durable units, or eventual upgrading to a durable housing unit, by the use of the durable separating wall components.

Furthermore, through the use of a particular arrangement of the wings of the non-durable components relative to the separating walls, the contemporary patio concept may readily be employed, but under conditions in which patio privacy may be maximized.

Accordingly, it is a primary object of the present invention to provide a novel complex of patio houses.

It is a further object of this invention to provide a novel patio house arrangement.

It is another object of this invention to provide a novel concept of patio house arrangement whereby permanent housing zones separated by durable walls are provided with shelter units of the non-durable type.

It is a further object of this invention to provide each of the objects set forth above, wherein provision is made for a pair of patio zones associated with each said house.

Other objects having an advantage as to the present invention will be readily apparent to those skilled in the art from a reading of the following brief descriptions of the drawing figures, detailed descriptions of the preferred embodiments, and the appended claims.

BRIEF DESCRIPTIONS OF THE DRAWING FIGURES

DETAILED DESCRIPTIONS OF THE PREFERRED EMBODIMENTS

Figure 1:
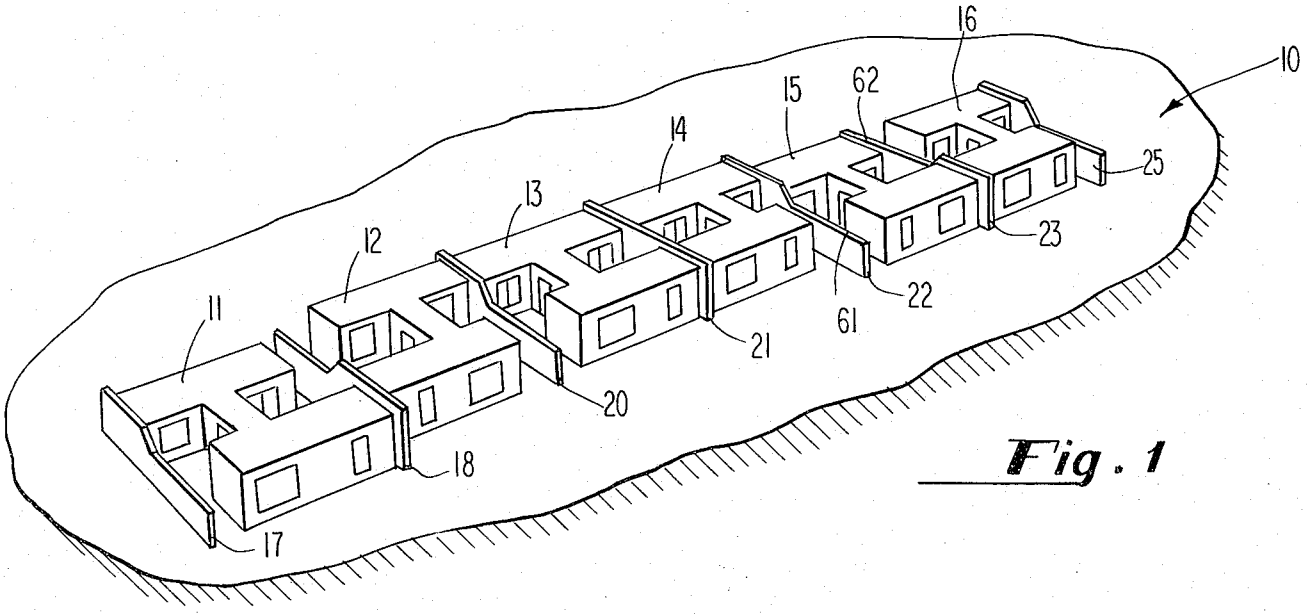
FIG. 1 is a top perspective view of a housing complex, or portion thereof, in accordance with the present invention.

Refering now to the drawings in detail, reference is first made to FIG. 1, wherein there is illustrated a housing complex generally designated by the numeral 10, as comprising six different houses: 11, 12, 13, 14, 15, 16, separated by five different separating walls: 18, 20, 21, 22, 23, and with end separating walls 17 and 25 also being provided, at opposite ends of the series.

It will be apparent that the illustration of FIG. 1 is for purposes of example only, to demonstrate the basic concepts in accordance with the present invention, and that in an actual housing complex of the type of the present invention, a plurality of series will be utilized. Some of those series may be oriented or disposed in angular relationships relative to other in the series. Some series may employ only two houses that in turn employ three spacedapart separating units or walls. Other series arrangements may employ other housing arrangements, sometimes adjacent houses being staggered somewhat relative to each other. It will further be apparent that there are virtually no limitations upon the employment of this concept, insofar as community planning is concerned, for purposes of arranging homes relative to each other, and relative to desired facilities, as such will be apparent from the present invention.

Figure 2:
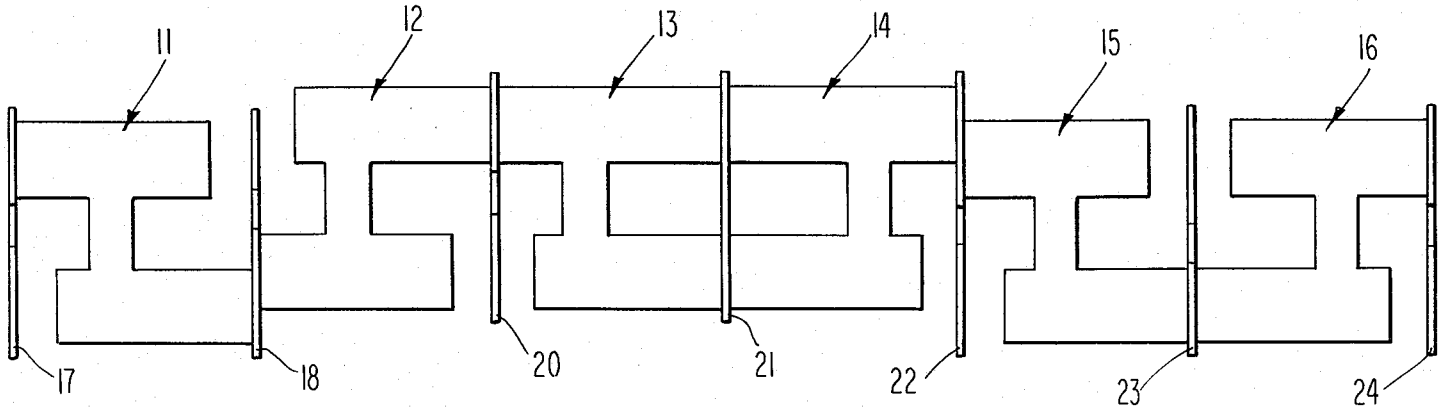
FIG. 2 is a top plan view of the complex of FIG. 1.
Figure 3:
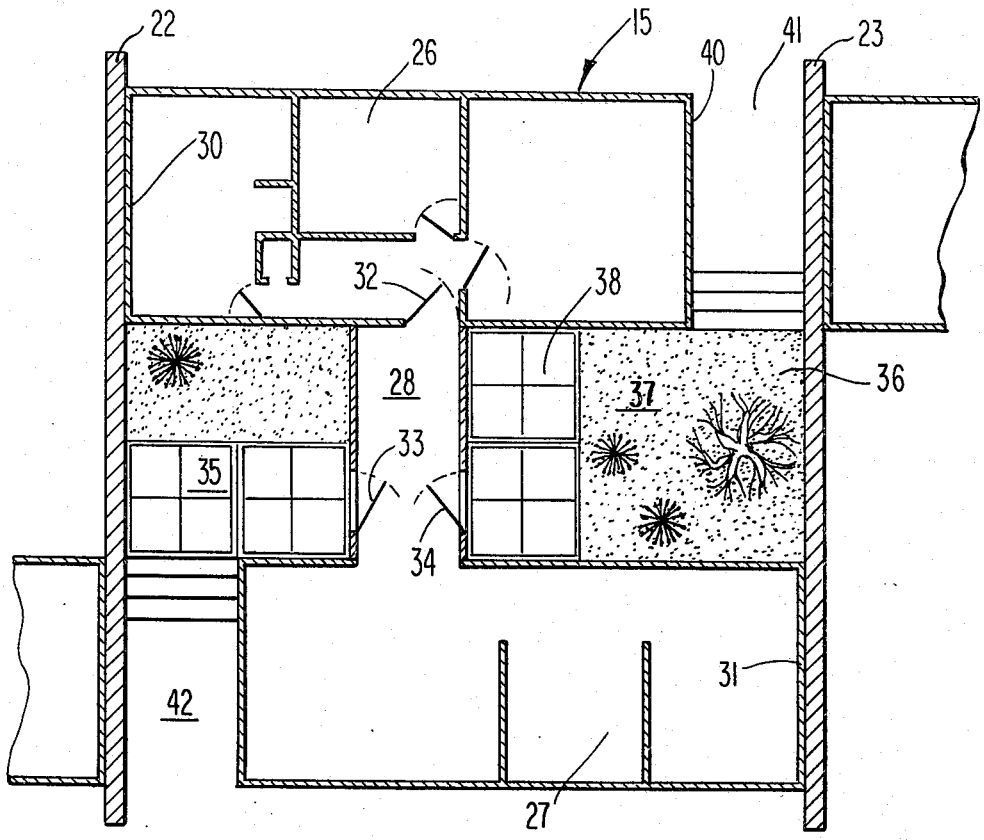
FIG. 3 is a horizontal sectional view taken through one of the housing units or houses and associated separating walls in accordance with this invention, with different patio zones, internal room separators and the like being further illustrated, and with adjacent houses being fragmentally illustrated.

With particular reference to FIG. 3, the house 15, illustrated in FIGS. 1 and 2 as part of a series is illustrated more specifically. The house 15 is shown disposed between a pair of adjacent separating walls 22 and 23, which separating walls are of the durable type. In the context of the present invention, this means that they are generally of permanent construction; as for example, being of a masonry-like construction (e.g.) masonry or concrete types, with or without reinforcing members, now shown, or even being of rather permanent steel, tile, or like constructions that tend to make them permanent as would generally outlast more temporary constructions, such as of the mobile home type.

The house 15 is constructed of a pair of housing wings 26 and 27, connected by an interconnecting part 28.

Each of the housing components or wings 26 and 27, as well as the interconnecting part 28 is of the generally non-durable construction as disclosed herein, and most specifically, the housing units 26 and 27 will generally be of the mobile home type, with or without wheels. These units 26, 27, and 28, being non-durable, will tend to depreciate more rapidly than would the separating walls 22 and 23, assuming that the separating walls 22 and 23 are of the preferred more durable constructions. Thus, within the concept of the present invention, from time to time it may be necessary to replace the non-durable housing units 26, 27, and 28 within the housing zone provided between the more durable units that comprise the separating walls 22 and 23.

It will be noted that each of the wings 26 and 27 is arranged with a short end thereof adjacent the side of an adjacent separating wall 22 and 23, as shown at 30 and 31, preferably in abutment therewith, in that the wings 26 and 27 are generally arranged perpendicularly to the walls 22 and 23. Each of the wing units 26 and 27 may have suitable dividers therein, separating the wings into suitable housing rooms, such as bedrooms, living room, kitchen, and the like, as desired, with the usual complements of living, including internal doorways and the like. The connecting part 28 will be provided with access to each of the wings as desired, either directly as is illustrated with respect to wing 27, or through a doorway 32 as is illustrated with respect to wing unit 26. Generally, the interconnecting part 28 is provided with an access opening of the door type 33, 34, to one or more patio zones 35, 36. The patio zones 35, 36, may or may not contain garden portions 37, and may or may not contain portions having hardened surfaces 38 of the concrete, flagstone, or other suitable types, depending upon the desired features, even including wood decking.

Generally, there will be provided outside access to a patio zone 36, past one end 40 of one of the wings 26, between that wing 26 and a separating wall 23 spaced therefrom. Such access opening 41 providing access to the patio 36, and consequently to the interconnecting part 28 through a doorway or the like 34. In an arrangement of this type, the interconnecting part 28 serves as an entryway. Another doorway 33 provides access to a patio 35, that also leads to an access opening 42, to outside the house 15. It will thus be seen that the patio zone 36 is bounded or defined by the wall 23, the wings 26 and 27, and the interconnecting part 28, as well as the access opening 41. Similarly, the patio zone 35 is likewise bounded.

Figure 4:
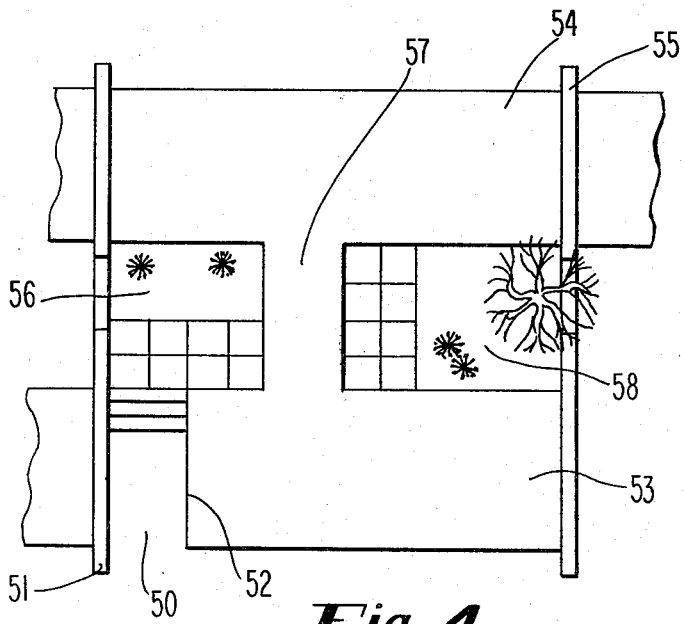
FIG. 4 is a top plan view, on smaller scale than FIG. 3, of an alternative housing construction, slightly modified from that of FIG. 3, to utilize only one access opening to a patio from outside the house.

With specific reference to FIG. 4, an alternative arrangement is illustrated, whereby an access opening 50 is provided between a separator wall 51 and an adjacent end 52 of a housing wing 53. Another housing wing 54 is provided between the separator wall 51 and the separator wall 55. The access opening 50 leads to a patio zone 56, that in turn provides access to an interconnecting part 57. Another patio zone 58, closed to access from the outside without passing through the house 57, is bounded by the interconnecting zone 57, wings 53 and 54, and the separating wall 55.

It will thus be apparent that by using mobile homes of different lengths, and even different widths, various combinations may be made. Furthermore, different arrangements may be made for patio zones.

It will be noted that other arrangements may be utilized to enhance the aesthetics of the complex, such as by the use of separating walls 22 and 23 that have recessed portions 61 and 62, to provide increase diversity and break up the arrangement somewhat of a given series within a complex.

Another advantage resides in the use of durable construction for the separating walls, in that the separating walls are generally party walls, and this serves to reduce the transmission of noise and the like from one house to another in a series.

It will be apparent from the foregoing that various other arrangements may be made, within the housing concept of the present invention, or within the spirit and scope of the invention, as defined in the appended claims.

What is claimed is:

1. A complex of patio houses, each house comprising a pair of mutually parallel wings being of a generally mobile home type and an interconnecting part disposed in connecting relation to said wings, wherein said complex comprises a series of at least two said houses, with adjacent houses in said series having separator walls therebetween which separator walls are distinct from, non-integral with, and do not comprise the walls of any said houses; said separator walls in each series being generally parallel to each other and being of masonry-like construction, each said house being arranged with its wings being disposed generally perpendicular to associated said separator walls and having at least one end of each wing adjacent a said associated separator wall, each said house having at least one patio zone bounded by the two wings, the interconnecting part, a said associated separator wall, and an access opening to said patio zone, with at least one of the wings of each said house being of a lesser length than the spacing between the separator walls at opposite ends of the house comprising means that together with said spaced separator wall defines said access opening.

2. A complex of claim 1, wherein at least one said house in said complex has two spaced-apart patio zones, each substantially bounded by the two wings, the interconnecting part, and an adjacent separating wall.

3. The complex of claim 1, wherein at least one said house in said complex is provided with an additional said patio zone.

4. The complex of claim 1, wherein each of said house wings of at least one said house in said complex is of a lesser length than the spacing between separator walls at opposite ends of the house to define two access openings, the openings being arranged on opposite ends of the house.

5. The complex of claim 1, wherein said wings and interconnecting parts are of the non-durable type.

6. The complex of claim 1, wherein different portions of at least some of said separator walls are of different heights.

7. The complex of claim 1, wherein said interconnecting part comprises a house entryway opening off at least one patio.

8. The complex of claim 1, wherein at least one said house in said complex is provided with an additional said patio zone, and wherein said wings and interconnecting parts are of the non-durable type, and wherein said interconnecting part comprises a house entryway opening off at least one patio zone.

* * * * *

UNITED STATES PATENT OFFICE

CERTIFICATE OF CORRECTION

Patent No. 3,996,709 Dated December 14, 1976

Inventor(s) Weld Coxe

It is certified that error appears in the above-identified patent and that said Letters Patent are hereby corrected as shown below:

Column 2, line 31, "now" should be --not--.

Signed and Sealed this

Fifth Day of April 1977

[SEAL]

*Attest:*

RUTH C. MASON
*Attesting Officer*

C. MARSHALL DANN
*Commissioner of Patents and Trademarks*